United States Patent [19]

Giese et al.

[11] Patent Number: 4,727,602

[45] Date of Patent: Mar. 1, 1988

[54] INSULATED HANDWEAR CONSTRUCTION

[75] Inventors: Erik O. Giese; Roger Brown, both of Aspen, Colo.

[73] Assignee: The Marmon Group, Inc., Chicago, Ill.

[21] Appl. No.: 799,039

[22] Filed: Nov. 18, 1985

[51] Int. Cl.[4] ..... A41D 19/00; H05B 1/00

[52] U.S. Cl. ..... 2/163; 2/159; 2/160; 2/161 R

[58] Field of Search ..... 2/163, 158, 159, 160, 2/164, 168, 161 R, 252; 36/2.6; 219/211, 212

[56] References Cited

U.S. PATENT DOCUMENTS

| | | | |
|---|---|---|---|
| 983,649 | 2/1911 | Scully | 2/161 R |
| 1,437,318 | 11/1922 | Kyle | 2/161 R |
| 2,004,382 | 6/1935 | Palicki | 2/164 |
| 2,040,137 | 5/1936 | Jensen | 2/161 R |
| 2,535,482 | 12/1950 | Spector | 2/163 |
| 2,657,391 | 11/1953 | Crandon | 2/161 R |
| 2,840,825 | 6/1958 | Garrido | 2/252 |
| 2,842,771 | 7/1958 | Foti | 2/159 |
| 3,084,241 | 4/1963 | Carrona | 219/211 |
| 3,501,616 | 3/1970 | Arron | 219/211 |
| 3,548,413 | 12/1970 | Jackson | 2/161 R |
| 3,703,007 | 11/1972 | Stewart | 2/163 |
| 3,916,448 | 11/1975 | Hamel | 2/161 R |
| 4,021,640 | 5/1977 | Gross et al. | 2/161 R |
| 4,107,509 | 8/1978 | Scher et al. | 219/211 |
| 4,214,321 | 7/1980 | Nuwayser | 2/161 R |
| 4,430,759 | 2/1984 | Jackrel | 2/164 |
| 4,555,813 | 12/1985 | Johnson | 2/161 R |
| 4,559,646 | 12/1985 | Ertl | 2/161 R |

FOREIGN PATENT DOCUMENTS

| | | | |
|---|---|---|---|
| 2721538 | 11/1978 | Fed. Rep. of Germany | 2/163 |
| 2818460 | 11/1979 | Fed. Rep. of Germany | 2/159 |
| 3027061 | 3/1982 | Fed. Rep. of Germany | 2/159 |
| 2444414 | 8/1980 | France | 2/164 |

*Primary Examiner*—Timothy F. Simone
*Attorney, Agent, or Firm*—Pennie & Edmonds

[57] ABSTRACT

An insulated handwear construction which has an outer shell, an inner lining and an insulation material having thermal convection passages therein positioned between the shell and inner lining. The insulation material connects to a source of heat located on either the palm side or back side of the handwear construction and extends over finger and thumb portions to transfer heat from the heat source to the finger and thumb tips of a wearer.

13 Claims, 9 Drawing Figures

INSULATED HANDWEAR CONSTRUCTION

FIELD OF THE INVENTION

This invention relates to an insulated handwear construction and more particularly to a glove or mitten construction having convection passages by which heat may be transferred from a heat source to and around the tips of the fingers and thumb of a wearer.

BACKGROUND OF THE INVENTION

Many forms of insulating handwear constructions have been proposed either in the form of gloves or mittens utilizing various combinations of outer shells, liners and insulation material in an attempt to provide warmth to a wearer. Most constructions involve combinations of an outer shell, usually made of a leather or fabric material, which is combined with an inner pile-like lining or other insulation material in an attempt to provide warmth and comfort. Some constructions, as, for example, those disclosed in U.S. Pat. No. 4,021,640, have utilized insulating mesh material extending over the front, tip and back portions of the fingers and thumb. These constructions provide an insulating barrier to the outside for keeping the fingers and thumb warm. Alternatively, electrically conductive elements, connected to a power source, and can be included to extend over the backs of the fingers and thumbs and around the tip portions to provide positive heat to the finger and thumb tips. While these latter constructions have been effective to heat those sections of the hand which are most sensitive to cold, they do require use of battery means which have limited capacity.

It is therefore an object of our invention to provide for an insulated handwear construction that is applicable for use with either glove or mitten constructions and which will have thermal convection passages therein by which heat may be transferred from a source of heat in the hand, or externally of the hand, to those portions of the hand most sensitive to cold.

2. General Description of the Invention

Broadly, an insulated handwear construction according to our invention comprises an outer shell, an inner lining and an insulation material positioned between the outer shell and inner lining. The outer shell conventionally comprises leather or fabric material while the inner lining may conventionally comprise a pile-like material or other insulating materials with both the outer shell and inner lining extending over the complete hand. The intermediate insulation material according to the invention has thermal convection passages therein which extend from a center part of the handwear construction, over the one side of the fingers and thumb, around the tips and over a part of the opposite side thereof. In addition, the thermal convection passages of the insulation material are in thermal contact with a source of heat, as, for example, the heat naturally in the palm of the hand or eminating from an external heating means.

In one form of the invention where the source of heat comprises the palm of the hand of the wearer, the insulation material comprises a palm section and five strip sections joined to or formed integrally with the palm section. Four of the strips overlie the palm side of the four fingers and the fifth strip overlies the palm side of the thumb of a wearer. Heat is transferred from the heat source of the palm of the hand through the convection passages to and around the tips of the fingers and thumb of a wearer to warm the same. In this particular form of the invention the handwear construction is in the form of a glove.

The handwear construction may also take the form of a mitten in which the palm section of the insulation material is adapted to overlie the palm of a hand of the wearer and a flap of the insulation material is joined to or formed integrally with the palm section with the flap overlying the palm side of four fingers of a wearer and a thumb strip overlying the palm side of the thumb of a wearer. In this form, heat is transferred from the palm of a wearer to and around the tips of the fingers and thumb; and the palm serves as the heat source.

Instead of having the palm of the wearer constituting a heat source, a separate heat source in the form of a battery powered electrical resistance heater or a catalytic chemical heater may be included in a package. The package is constructed to fit into a pouch contained in the glove or mitten. It is positioned adjacent to and contacting a portion of the insulation material overlying either the back part or the front part of the hand of the wearer.

When the external heater construction is used with a glove, the insulation material comprises a back section and five separate strips, with four of the strips adapted to overlie the back side of four fingers of the wearer and the fifth adapted to overlie the back of a thumb. When the handwear construction utilizing such an electrical or chemical source of heat comprises a mitten, the insulation material comprises a back section and a flap adapted to overlie the back sides of four fingers of the wearer and a separate thumb strip adapted to overlie the back side of a thumb of a wearer.

Preferably the insulation material comprises a material having threads protruding from one side thereof so that the threads form convection passages from the lower part of the hand, to and around the finger and thumb tips. The protruding threads provide a compression resistant means to prevent collapse of thermal convection passages formed by the threads.

The insulation material may have a plastic film affixed thereto on the side thereof adjacent the shell structure of the glove or mitten to further define the convection passages. Also, the inner lining may have perforations therein near the source of heat, either at the palm portion or near the electrical or chemical heat source and adjacent the finger tips and thumb tip. These perforations will then provide air inlet passages for the thermal convection passages near the source of heat and air exit passages near the finger and thumb tips to improve convection flow of air from the source of heat to transfer heat to the finger and thumb tips.

The handwear construction may also include a waterproof lining positioned between the outer shell and the insulation material. This waterproof lining extends over the complete hand and provides a barrier between the moisture entering into the interior of the handwear construction from a source exterior of the outer shell. This particular lining, in addition, is breathable so that vaporized moisture contained within the handwear construction may move from the interior thereof outwardly to the exterior.

Further, the handwear construction utilizing the principle of having the insulation material form convection passages can be accomplished by employing essentially three separate parts, each of which covers the complete hand. More particularly, such a construction includes an outer shell, an inner liner and an insulation material fully separating the shell and liner. All three parts are in the form of a glove if the handwear construction is a glove or in the form of a mitten if the construction is a mitten. It is further preferable in this instance that the insulation material be made of components that have stretch characteristics in order to facilitate flex of the glove construction and comfort to the wearer.

DESCRIPTION OF THE PREFERRED EMBODIMENTS

Figure 1:
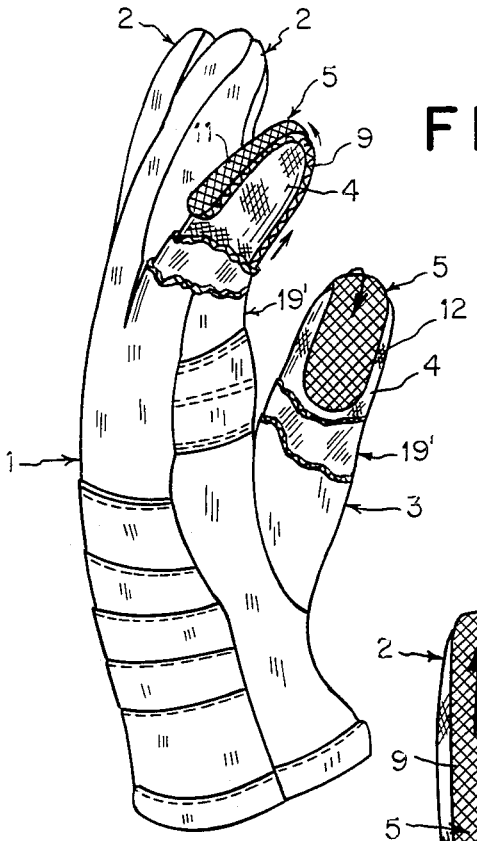
FIG. 1 is a broken side view of an insulated handwear contruction according to the invention in the form of a left-hand glove.
Figure 2:
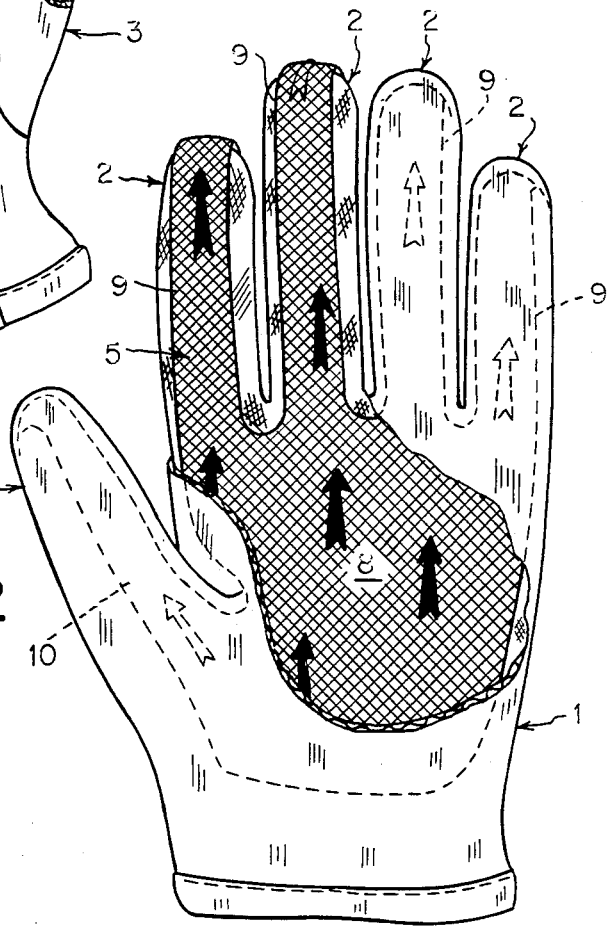
FIG. 2 is a broken palm side view of the glove of FIG. 1.

Referring to FIGS. 1 and 2, there is illustrated handwear construction according to the invention in the form of a glove adapted for use with the left-hand of a wearer. As shown, the glove includes an outer shell 1 with finger portions 2 and a thumb portion 3. The shell is made of leather or fabric material. The glove also has an inner lining 4 which covers the complete hand and which may comprise a pile-like material or other material such as an insulating material.

An insulation material 5 is positioned between the outer shell 1 and the inner lining 4 and comprises a palm section 8, adapted to overlie the palm of the hand of a wearer, and five strip sections with four of the strips 9 adapted to overlie the palm sides of the fingers and the fifth strip 10 adapted to overlie the palm side of the thumb of a wearer. Strips 9 extend around the tips of the finger portions 2 and over a part 11 of the back side of the finger portions while the strip 10 extends over the tip of the thumb portion 3 and a part 12 of a portion of the back side of the thumb portion.

Figure 3:
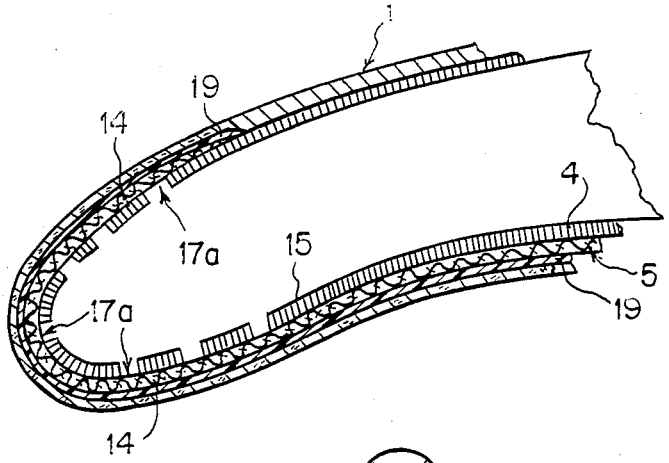
FIG. 3 is a enlarged cross-sectional view of a finger portion of a handwear construction according to the invention.

The insulation material 5, best shown in FIG. 3, comprises a mesh-like plastic material having a plurality of monofilament threads 14 extending from one side thereof to form a compression resistant means preventing collapsing of the spacing between the threads 14. This spacing between the threads 14 forms thermal convection passages 15 which along with insulation material extend, as shown in FIG. 2, from the palm section 8 through the strips 9 and 10 over the tips of the finger and thumb portions with the result that heat is transferred from the normally warmer palm of the hand to the finger tips of a wearer.

Figure 4:
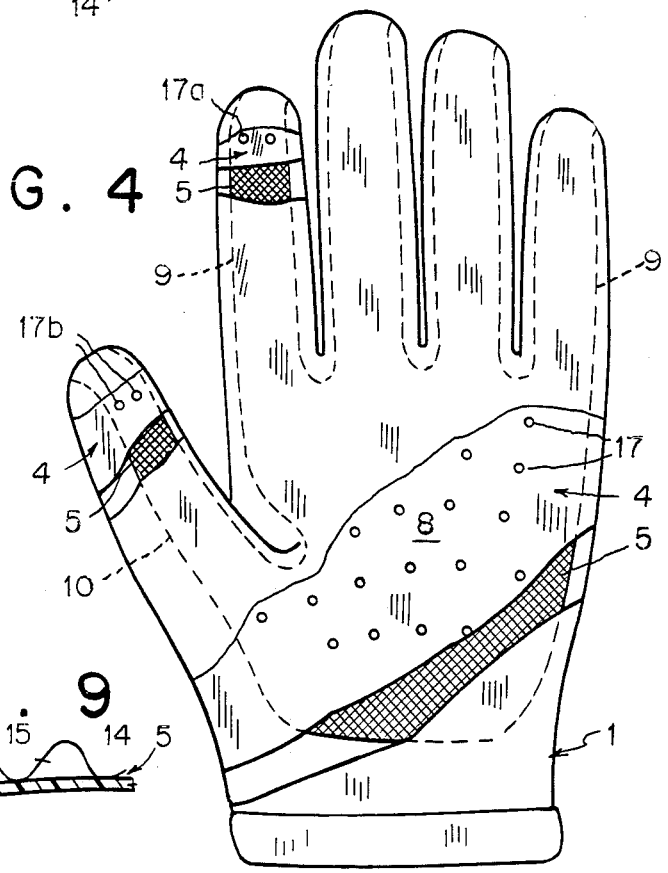
FIG. 4 is a view similar to FIG. 2 of a glove in which insulation material contained within the glove is used with a perforated inner lining.
Figure 9:
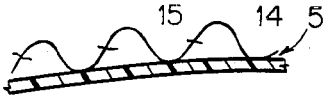
FIG. 9 is an enlarged view of the mesh-like plastic material and monofilament threads of the insulation material taken from the lower right portion of FIG. 3.

The inner lining 4 shown in FIG. 4 has a plurality of perforations 17 covering the palm section of the insulation material and a further plurality of perforations 17*a* covering the ends of the strips 9 of the insulation material. Perforations 17 act as air inlet openings and perforations 17*a* as air outlet openings for the thermal convection passages 15 to further assist in movement of warm air from the palm of a wearer to the finger tips of a wearer. Similarly, perforations 17*b* are included in the lining covering the end of the strip 10 to assist air flow from the warmer palm of a wearer to the thumb tip. In this form of the invention, the palm of a wearer serves as a source of heat for heating finger and thumb tips.

In some forms of the invention, an additional plastic film 19 in the form, for example, of a thin layer of polyurethane can be provided. When used, it is placed or bonded onto the side of the insulation material facing the shell portion of the handwear. Its purpose is to further define the convection passages 15 and prevent convection outwardly toward the shell. In any of the forms of the invention, it may be advisable to provide a waterproof outer lining 19 to the handwear construction in the form of a complete liner fitting within the outer shell. This waterproof lining, as shown in FIG. 1, preferably comprises an expanded Teflon material which is in the same shape as the shell 1 and inner lining 4 and which will prevent passage of moisture droplets through the outer shell but which will allow passage of water vapor therethrough, thus providing a breathing action to the material. A material which meets these requirements is sold under the trademark "Gore-Tex" by the Gore Tex Company of Elkton, Maryland.

Figure 5:
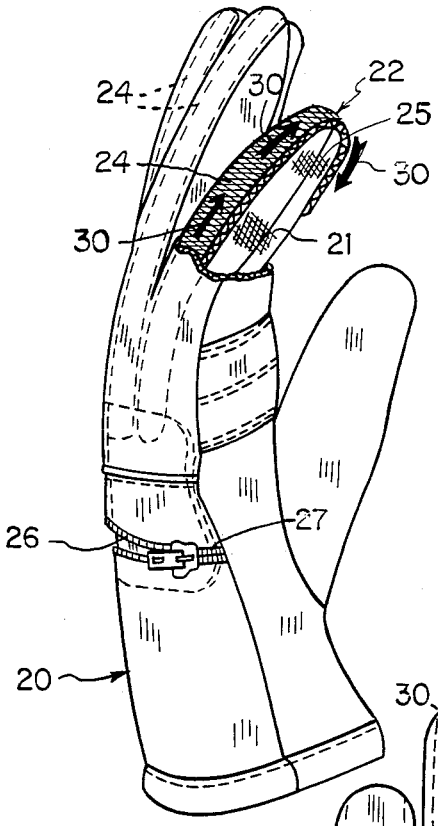
FIG. 5 is a broken view of a left-hand glove construction of a further embodiment of the invention.
Figure 6:
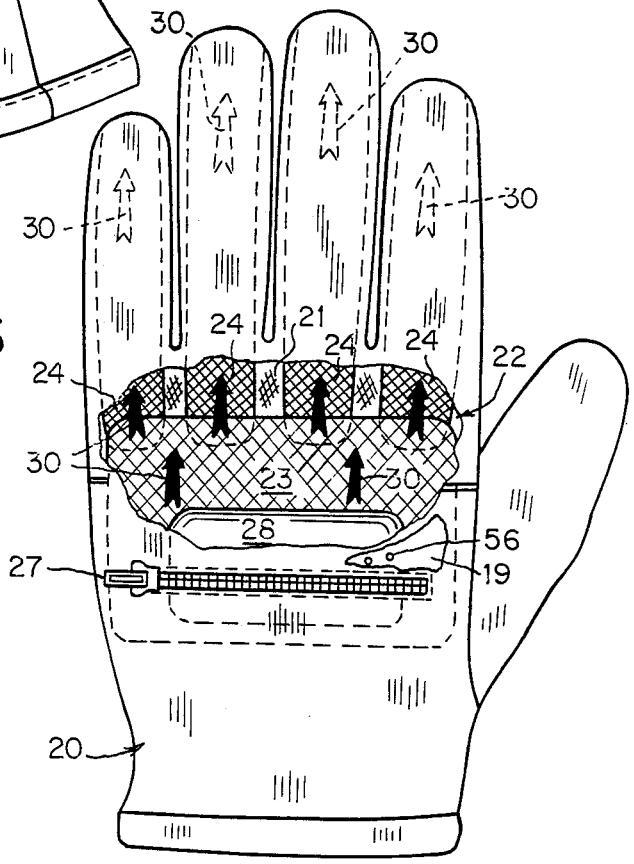
FIG. 6 is a broken view of the back side of the glove of FIG. 5.

Referring to FIGS. 5 and 6, there is illustrated a handwear construction in the form of a glove which utilizes a catalytic or electrical heat source for heating the finger and thumb tips. In this construction, the glove comprises an outer shell 20 and an inner lining 21 comprising the same materials as in the constructions shown in FIGS. 1–4. In this instance, however, the center part of the insulation material 22 comprises a back section 23 adapted to overlie the back of the hand of a wearer and from which four finger strips 24 extend over the back of the finger portions of the glove, over the tips of the finger portions and over a short part 25 of the palm side of the finger portions. The thumb portion also has a strip (not shown) which likewise extends from the back section 23 over the back of the thumb portion around the tip and down a portion of the palm side of the thumb.

The outer shell 20 includes a pouch 26 therein having a zipper 27 or other fastening means and into which catalytic-type heat pack 28 may be inserted. This pack overlies and is in thermal contact with the back section 23 of the insulation material. The heat pack thus serves as a source of heat which is transferred to the finger tips through the convection passages contained in the insulation material. While we prefer to have a catalytic heat pack, it is obvious other sources of heat may be used as, for example, an electric grid connected to a battery, both of which could be contained within the pouch. Also, the heat pack can be contained in a pocket formed on the palm side of the handwear construction, in which case the insulation material will be constructed as in FIGS. 1 and 4.

In the glove construction of FIGS. 5 and 6, the insulation material may have a plastic film 19 on the outside thereof. In this event, perforations 56 will be included in the film adjacent the back of the hand to form air inlet passages communicating with the heat source in the pouch 26.

Figure 7:
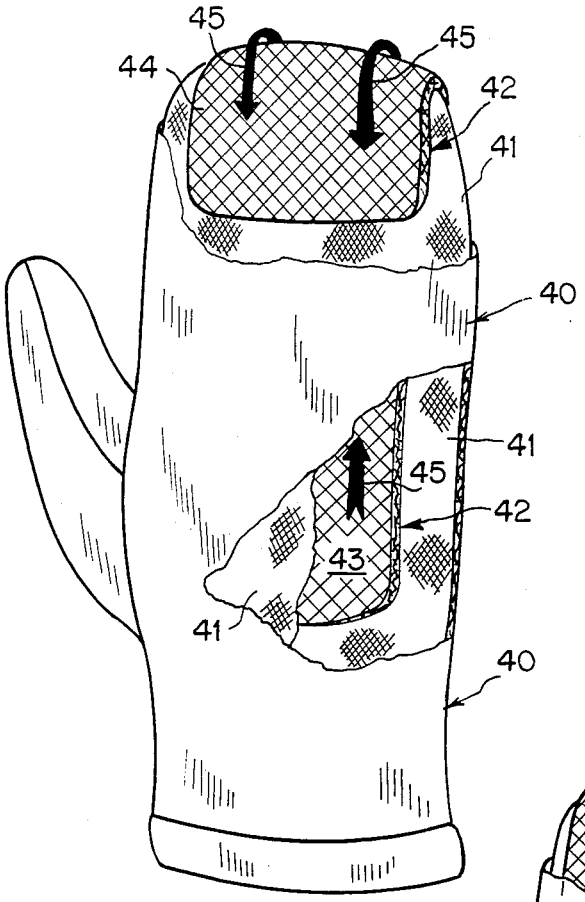
FIG. 7 is a broken view of the back side of a handwear construction according to the invention in the form of a right-hand mitten.
Figure 8:
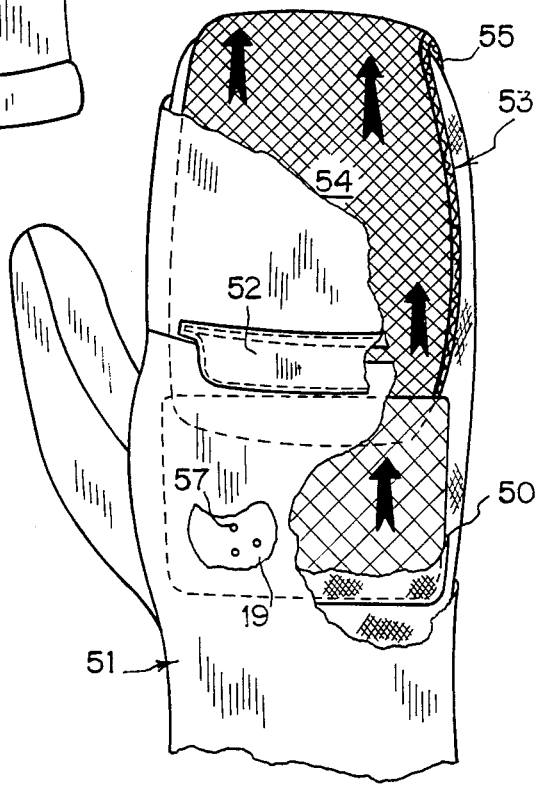
FIG. 8 is a broken view of the back side of a further embodiment of a right-hand mitten according to the invention.

Referring to FIGS. 7 and 8, there are illustrated insulated handwear constructions according to the invention in the form of right-hand mittens. In the construction shown in FIG. 7, the mitten comprises an outer shell 40 and an inner insulation lining 41. An insulation material 42 of the same type as used in the glove constructions of FIGS. 1–4 has a palm section 43 which is adapted to overlie the palm of a wearer in the same manner as the palm section 8 shown in FIG. 2. The insulation material also includes a flap 44 which extends from the palm section over and around the end of the mitten and over the finger tips of a wearer and down a portion of the back side of the mitten such that the material will form convection passages extending from the palm section to and around the finger tips. Heated air will thus flow in the direction of the arrows 45 from the palm of the hand of a wearer to and around the finger tips. The construction of the thumb portion is identical with that shown in FIG. 2 and includes a strip of insulation material extending from the palm section of the insulation material, along the inside of the thumb portion and over the tip thereof. As with any of the constructions of FIGS. 1–6, the insulation material may have a plastic film, like film 19 shown in FIG. 3, bonded thereto to further define the convection passages. Also, a plastic outer liner of a breathable moisture impervious material, like waterproof lining 19' of FIG. 1 may be provided. Still further, the inner lining 41 may include perforations in the palm portion and finger and thumb portions to assist in the convection flow of heated air as previously described.

The mitten construction of FIG. 8 is akin to the glove constructions shown in FIGS. 5 and 6 in that the back of the mitten includes a pouch 50 contained in the outer shell 51 into which may be inserted a source of heat in the form of a catalytic heat pack or electric resistance element. A cover 52 closes the opening of the pouch. As with the construction of FIGS. 5 and 6; the pouch can also be formed on the palm side of the mitten. In the form of the invention shown in FIG. 8, the insulation material 53, which is the same as that as previously described, includes a back section 54 which is in thermal contact with the interior of the pouch 50 and thus with the source of heat contained in the pouch 50. The insulation material also includes a flap portion 55 which extends over the end of the mitten. The mitten, if desired, may include the convection defining film 19 and/or the waterproof lining 19' affixed on the shell side of the insulation material. When used, perforations 57 will be provided in the film at the back portions to assist in flow of warm air from the heat source to the finger portions of the mitten.

While the drawings illustrate the insulation material being less than a full liner, the insulation material can be in the form of a glove or mitten and comprise a full liner positioned between the outer shell and inner pile lining. In this event, it is desirable that the meshlike insulation material comprise a flexible plastic material having slight stretch characteristics in order to facilitate flexing of the handwear construction and comfort to the wearer.

We claim:

1. Insulated handwear construction having an outer shell, an inner lining and an insulation material positioned between said outer shell and said inner lining and adapted to extend over a portion of a hand of a wearer, characterized in that:

(a) said insulation material has convection passages therein; and (b) said insulation material having convection passages extends from a center part of the handwear construction with the convection passages in thermal contact with said center part, where the passage are adapted to be connected with a source of heat, and over one side of finger portions around tips of the finger portions and over a part of the opposite sides of the finger portions where the convection passages are in thermal contact therewith whereby heat may be transferred from said source around the tips of the fingers of a wearer:

2. Insulated handwear construction according to claim 1 further characterized in that:

(a) said center part comprises a palm portion of said handwear construction adapted to cover the palm of a wearer; and (b) the convection passages are in thermal contact with the palm of the hand of a wearer which defines said source of heat.

3. Insulated handwear construction according to claim 2 further characterized in that:

(a) said construction is in the form of a glove; and (b) said insulation material comprises a palm section adapted to overlie the palm of a hand of a wearer and five strips extending from the palm section with four of said strips overlying the palm side of four fingers of the glove and the fifth strip overlying the palm side of the thumb of the glove.

4. Insulated handwear construction according to claim 2 further characterized in that:

(a) said construction is in the form of a mitten, and (b) said insulation material comprises a palm section adapted to overlie the palm of a hand of a wearer and a flap section extending from the palm section and adapted to overlie the palm side of four fingers of a wearer and a thumb strip extending from the palm section and adapted to overlie the palm side of a thumb of a wearer.

5. Insulated handwear construction according to any one of claims 1–4 further characterized in that:

(a) the inner lining includes perforations in the area of said heat source and near the finger and thumb tip portions to assist movement of air through said convection passages from said source of heat to the finger and thumb tip portions.

6. Insulated handwear construction according to claim 5 further characterized in that:

(a) said insulation material comprises a mesh-like material having monofilament threads protruding from one side thereof to form said convection passages and to further form compression resistant means to prevent collapse of said convection passages.

7. Insulated handwear construction according to claim 6 further characterized in:

(a) an outer plastic film positioned between the insulation material and said outer shell.

8. Insulated handwear construction according to claim 1 further characterized in that:

(a) said center part comprises a back portion adapted to overlie the back of a hand of a wearer; and (b) a pouch is contained in said outer shell adjacent to and contacting the back portion and adapted to contain a heating element to serve as said source of heat.

9. Insulated handwear construction according to claim 8 further characterized in that:

(a) said construction is in the form of a glove, and (b) said insulation material comprises a back section adapted to overlie the back of a hand of a wearer in thermal contact with said pouch and five separate strips joined to the back section with four of said strips adapted to overlie the back side of four fingers of a wearer and a fifth strip adapted to overlie the back side of a thumb of a wearer.

10. Insulated handwear construction according to claim 8 further characterized in that:

(a) said construction is in the form of a mitten and (b) said insulation material comprises:

(1) a back section adapted to overlie the back of a hand of a wearer in thermal contact with said pouch;

(2) a flap joined to the back section with said flap adapted to overlie the back sides of four fingers of a wearer, (3) and a thumb strip joined to the back section adapted to overlie the back side of a thumb of a wearer.

11. Insulated handwear construction according to any one of claims 8–10 further characterized in:

(a) an outer plastic film is positioned between said insulation material and said outer shell; and (b) perforations are provided in the said plastic film in the area of said pouch to assist movement of air through said convection passages from said source of heat to the finger and thumb tip portions.

12. Insulated handwear construction according to any one of claims 1–4 and 8–10 further characterized in that:

(a) said insulation material comprises a mesh-like material having monofilament threads protruding from one side thereof to form said convection passages and to further form compression resistant means to prevent collapse of said convection passages.

13. Insulated handwear construction according to claim 7 further characterized in:

(a) a waterproof lining is positioned between said insulation material and said outer shell.

* * * * *